United States Patent [19]

Preussner

[11] Patent Number: 4,756,149

[45] Date of Patent: Jul. 12, 1988

[54] STRANDING MACHINE SYSTEM

[76] Inventor: Theodor Preussner, Ermlandstrasse 92E, D-3004 Isernhagen 2, Fed. Rep. of Germany

[21] Appl. No.: 897,786

[22] PCT Filed: Nov. 26, 1985

[86] PCT No.: PCT/EP85/00644

§ 371 Date: Jul. 15, 1986

§ 102(e) Date: Jul. 15, 1986

[87] PCT Pub. No.: WO86/03529

PCT Pub. Date: Jun. 19, 1986

[30] Foreign Application Priority Data

Dec. 8, 1984 [DE] Fed. Rep. of Germany ..... 3444902

[51] Int. Cl.[4] ..... D07B 3/08; D07B 7/10; B65H 54/02

[52] U.S. Cl. ..... 57/71; 57/58.52; 57/67

[58] Field of Search ..... 57/67–71, 57/58.52–58.57

[56] References Cited

U.S. PATENT DOCUMENTS

| | | | |
|---|---|---|---|
| 2,484,178 | 10/1949 | MacCreadie | 57/71 |
| 3,413,793 | 12/1968 | Stine et al. | 57/71 X |
| 3,926,072 | 12/1975 | Richardson | 57/71 X |
| 4,050,640 | 9/1977 | Henrich | 242/25 R |
| 4,235,070 | 11/1980 | Bravin | 57/71 |
| 4,389,838 | 6/1983 | Adelhard et al. | 57/71 |

FOREIGN PATENT DOCUMENTS

| | | |
|---|---|---|
| 192422 | 12/1907 | Fed. Rep. of Germany . |
| 1685848 | 3/1971 | Fed. Rep. of Germany . |
| 2037607 | 5/1973 | Fed. Rep. of Germany . |
| 2301594 | 8/1974 | Fed. Rep. of Germany . |
| 3209169 | 9/1983 | Fed. Rep. of Germany . |
| 3226572 | 1/1984 | Fed. Rep. of Germany . |

*Primary Examiner*—John Petrakes

*Attorney, Agent, or Firm*—Michael J. Striker

[57] ABSTRACT

In a stranding machine system with a single lay and take up device for the rope a take up coil (5) is provided and a single lay rotor (7) which rotates and encompasses the take up coil are coaxially disposed. The take up coil and the single lay rotor are moveable reciprocally relative to each other for generating a lay stroke for the rope in an axial direction and the rope is fed from the longitudinal axis of the single lay rotor along the same to the take up coil. For taking up a difference of the speeds is generated for the take up coil and the single lay rotor depending from the given obtained take up diameter of the take up coil. The take up coil with the nominal speed and the single lay rotor for generating the required speed for the differential speed are separately rotatably driven. Thereby, the take up roller may be mounted stationary free floating in axial direction and the single lay hollow rotor member may also be free floating mounted but reciprocally driven in axial direction.

14 Claims, 4 Drawing Sheets

STRANDING MACHINE SYSTEM

BACKGROUND OF THE INVENTION

The present invention relates to a stranding machine system with a single lay device and take up device for the rope. More particularly, it relates to a device of this type in which a take up coil and a single layer rotor, which rotates and encompasses the take up coil, are disposed coaxially with respect to each other, the take up coil and the single layer rotor are movable axially in a reciprocating movement relative to each other for generating a laying stroke for the rope, and the rope is guided along the single lay rotor to the take up coil, whereby for the take up process a difference of the speed of the take up coil and the single lay rotor is generated depending from the given obtained taking up diameter of the take up coil.

In a known stranding machine system of this type (disclosed in DE-PS No. 20 37 607) the rope is premade in a so-called prestranding machine with a driven drawing off device Thereafter the rope is fed to the single lay device and take up device in such a manner that it is fed to a single lay rotor in front of the take up coil and along the same to the take up roller This take up roller is mounted in a free lying manner, is separately driven and is reciprocally moved in axial direction for laying the rope. Therefore, the take up coil immerses into and out of the known single lay rotor. When the operating speed is obtained after the smooth start of the system, the speed of the single lay rotor remains constant until the take up roller is full or until an eventual emergency breaking is required, generally over a longer period of production. In order to take up the rope with the known system, the take up coil must rotate coaxially with the single lay rotor at a high speed. However, as is known the take up coil must have a certain differential rotating speed in relationship to the single lay rotor. Since the rope is fed with a constant trajectory speed or feeding speed, the speed of the take up roller must be adjusted in dependence on the instantaneous winding diameter and thereby on the degree of filling of the coil, as is well known. At first, the differential rotating speed of the almost empty coil will be relatively high in relationship to the single lay rotor, but reduces during an increasing take up diameter.

In the known systems (for example, in accordance with DE-PS No. 20 37 607 or in other comparable single lay devices and take up devices) the control of the rotating and stroke speeds of the reciprocating take up coil is performed in dependence on the predetermined rotating speed of the associated single lay rotor, on the one hand, and with consideration of the associated feeding speed of the rope derived therefrom, on the other hand, for maintaining constant rope lay lengths or tolerable rope tensile stress. Thereby, the take up roller is actually secondarily fed with respect to the primarily controlled single layer rotor.

Such an adaptation of the take up rotating speed and the laying stroke speed can be realized without any difficulties from the point of view of the control technology, as long as the production is performed with a constant rope speed or must be only slightly accelerated or delayed. However, for particularly rapid stranding machine systems the known solution of the single layer device and the take up device results in practically insuperable difficulties, i.e., for the following reasons: An increase in the lay number simultaneously leads to a highest degree of stranding speed or rope feeding speed and thereby also to a corresponding rotating speed for the take up coil, which either leads or lags with a relative low speed difference with respect to the single lay rotor in the known solution. A severe increase of the rotating speed of the separately driven take up coil in the known system results in undesirable high demands and disadvantages. In particular when stranding thin or tensile sensitive stranding elements difficulties occur for the following reasons: When taking up a rope on a take up roller which rotates around its own axis, the control of the tensile stress of the rope to be taken up is necessarily always associated with a corresponding change of the rotating speed of the coil. A take up drive must be provided, on the one hand, and a brake which acts on the take up coil, on the other hand. Unforseeable and quickly applied emergency braking of the take up roller are critical by maintaining a constant tensile stress in ropes and in particular with tensile sensitive ropes, for example, thin but multiwired high-voltage stranded wire made from copper. The particular difficulty for a coordinated rapid braking of the single lay rotor and the take up coil is that the take up coil which lags behind the rotor has a completely variable mass and above all an increased degree of a variable mass inertia moment depending on the obtained degree of take up. The dynamic mass inertia is proportionally of the fourth power of the obtained take up diameter. The braking moment is directly proportional to the mass inertia moment and the braking time is reversely proportional to the braking moment, which means, that for maintaining of uniform braking times a braking equipment would be provided for the single lay rotor, on the one hand, and the lagging take up coil, on the other hand, which would have to be equipped with an extremely high set range for the unforseeable large breaking moment. Thereby this equipment must also be able, despite an excessive variation span, to completely brake within a few seconds accurately controlled by high speeds. Such a braking equipment would be realizeable in practice only with great efforts and would therefore not be feasable either technically, or economically. In the known systems such emergency brakings would result in damages to the rope or in loop forming, or the like. Therefore, the worst disadvantage of the known systems is seen, above all, in that the take up coil must perform the axial lay stroke movement with its relatively large and variable mass, on the one hand, and must be controlled, i.e., must be controlled in its given movement conditions in its rotating speed during the operation and in particular during the described brakings, on the other hand.

SUMMARY OF THE INVENTION

It is therefore an object of the invention to provide a stranding machine system with a particular design of the single lay device and take up device, in which a reciprocating take up coil with its rotating speed controlled in dependence on the degree of its filling condition is eliminated, and in particular a sufficient taking up of the rope is obtained even with the highest lay speed and rotating speeds of rotating parts of the machine, while simultaneously danger of overstressing of the rope to be taken up and in particular tensile sensitive ropes is eliminated, and the obtainable speeds and numbers of lays are increased without the described shortcomings, also under extreme operating conditions, in particular during emergency braking, so that the described dangers for the rope to be taken up are eliminated.

This object is obtained in accordance with the invention in that the take up coil is driven with the nominal lay speed and the single lay rotor is driven with the speed which is required for generating the differential speed, and they are driven separately from one another. Thus, the advantage is obtained that the take up coil with its relatively large and in particular variable mass must not be subjected to a speed change. Instead, it is achieved that the single lay rotor which is easier to be designed with practically uniform mass is driven in dependence on the rope feeding speed or on the rope pull, on the nominal lay speed and on the instantaneous diameter of the take up coil, and with the given required own speed and can be controlled in its speed for generating the required differential speed, thus being able to be adjusted to the rotating speed of the take up coil. A further advantage is gained in that, in contrast to the described known systems, the single lay rotor, which encompasses the take up coil, can follow with its practically constant and relatively small mass and therefore constant, smallest possible mass inertia moment, the heavy take up coil which is variable in its mass inertia, i.e., even during the described rapid braking. The control of changing the speed of the single lay rotors is substantially simplified, in particular a so-called guided braking, since no control is required for the variable mass and thereby for the variable mass inertia moment of the take up coil. The single lay rotor with its very small and, above all, constant mass inertia moment may be braked during speed changes and in particular during braking, so that the described dangerous overstressings are eliminated, in particular in sensitive ropes and rope elements. Altogether, substantially higher speeds and lay speeds may be controlled during the take up process, in particular also in the case of braking.

In accordance with one embodiment of the invention the speed of the single lay rotor and thereby the differential speed between the take up coil and the single lay rotor is controlled in dependence on the tensile stress of the rope being fed to the single lay rotor, corresponding to the take up diameter on the take up roller. Since the change of the take up diameter on the take up coil results in a change in tensile stress of the rope being fed to the single lay rotor, this tensile stress is used in a simple manner for determining the required speed and thereby for a controlled take up process in dependence on the take up diameter. Simultaneously, the required tensile stress is obtained through this control for a constant maintenance being required for the drawing off of the rope element.

In accordance with another embodiment of the invention, the take up coil is mounted free lying and non-displaceable in axial direction, and the single lay rotor which encompasses the take up coil as a one sided closed hollow element is mounted free lying at the closed side facing away from the take up coil and is reciprocally driven in an axial direction. Thus, the advantage is obtained in that the take up coil and its drive with the nominal speed can be operated completely differently from the lay stroke movement and the control of the differential speed, while the lay stroke movement and the control of the differential speed can be performed through the single lay rotor with its low and, above all, constant mass. Therefore, the structural as well as the functional design of the lay stroke movement and the speed control for the single lay rotor is substantially simplified. A structural and functionally particularly advantageous embodiment of the invention is obtained in a further design in that the take up roller is mounted on a hollow drive shaft at the end facing away from the feeding side of the rope and that this shaft is mounted in a stationary machine part facing the feeding side of the rope, the single lay rotor is rotatably mounted on a shifting carriage on its drive shaft, which in turn is reciprocally driven on a stationary machine part and is rotatably and displaceably mounted on an extension of its drive shaft in the stationary machine part, and the rope is guided through the hollow drive shaft of the take up coil toward the end facing the single lay rotor and from there along the longitudinal axis of the single layer rotor to the take up coil. This construction enables at first a safe vibration free mounting of the take up coil, but simultaneously also its particular favorable position with respect to the encompassing single lay rotor. The hollow drive shaft of the take up coil may be connected in a suitable manner with the required rotating drive or with a suitable lay and/or drawing off device. At the feeding side of the rope of this single lay and take up device, the single lay rotor may be disposed and mounted in a favorable position because it is independent from the mounting and arrangement of the take up coil and can be driven in a rotatable as well as thrust driven manner. The described rope guide contributes advantageously to this particular favorable arrangement.

With a further embodiment of the invention it is possible to obtain a highest possible rope lay speed and quality. For this purpose, in a further embodiment of the invention, a prestranding machine is coaxially switched in front of the hollow drive shaft of the take up coil with a prestranding rotor with a driven drawing off disk being mounted on a hollow shaft, and the rope which is discharged from the hollow drive shaft is fed to the take up coil. Such a prestranding machine with a driven drawing off disk (for example, in particular a prestranding and drawing off device in accordance with DE-OS No. 32 09 169 enables a substantial reduction of the pretension or tensile stress in the rope, before it reaches the single lay and take up device in accordance with the invention. Therefore, this device is relieved from the task of drawing off, so that only the rope tensile stress has to be controlled within the limits of the device, which simplifies the design of the single lay and take up device substantially and enables a considerable high increase of the machine speed, i.e., the rope lay speed without increasing the generated tensile stress in an undue manner (for example, by centrifugal and friction forces).

The prestranding machine and the single lay and take up device in accordance with the invention can be combined in a simple manner in that the hollow drive shaft of the prestranding machine facing the take up rotor and the hollow drive shaft of the take up coil are formed as a unitary piece. Therefore, the prestranding rotor and the take up coil are fixedly coupled in their speeds and execute the nominal speed, whereby the single lay and take up device perform the required generation of the differential speed and the lay stroke movement in the manner described. The total stranding machine system can be compact and designed with simple drive and control means.

For guiding the rope to be taken up on the single lay rotor of the single lay and take up device it is essential that particularly tight curvature radii are avoided with this type of rope guiding and that in particular the transfer of the initially guided rope in longitudinal direction at the single lay rotor into the cross sectional plane to the take up coil is performed without any tight impairing curvature radii or even breaks during the changing take up direction. For this purpose, it had been shown to be advantageous that in a further embodiment of the invention the single lay rotor is provided with at least one radial outwardly directed protrusion at the outer circumference of its open end, which forms on its outer directed edge a curved guide path extending in a cross sectional plane, for the rope to be fed to the take up coil, and that the rope, after being fed on the inner face of the rotor jacket, is fed to the beginning of this guide path and moves from the end of the guide path to the take up coil, whereby the center point of the curvature circular segment of the end section of the guide path is disposed in such a manner that the common tangents of the coil core circle and the curvature circular segment meet at that point of the single lay rotor at which the rope exits the single lay rotor at the start of the take up process. Thus, it is assured that the rope never goes below a permissible curvature radius and that in particular the feeding of the rope to the take up coil remains at the end of the guide path without a nonpermissible curvature during the changing take up direction. At the lowest take up diameter, namely the diameter of the coil core circle at the start of the take up process, the rope is not subjected to any deflection when exiting the guide path and can lift off at the yielding locations of the guide path during the growing take up diameter, so that any additional curvature at the end of the guide path is eliminated.

In order to obtain a safe guiding of the rope at the open end of the single lay rotor, it is advantageous to provide the open end of the single lay rotor at the outer circumference with a collar which covers the guide path in a radial distance permitting the movement of the rope.

The single lay rotor can be provided with a rope guiding path on its closed bottom face extending coaxially with respect to the hollow drive shaft toward the take up coil and having a smaller diameter than the inner diameter of the hollow drive shaft, so that the rope is fed through it from the hollow drive shaft to the single lay rotor. In this construction a safe and essentially deflect free feeding of the rope in the longitudinal axis of the take up coil and single lay rotor is obtained. The rope guiding tube always encompasses the rope which moves in the longitudinal axis, since it constantly encompasses the rope path being generated by the lay stroke movement of the single lay rotor between the end of the take up coil and the bottom of the single lay rotor.

For reducing and controlling of eventual generated oscillations in the hollow drive shaft due to the free floating mounting of the take up roller it is advantageous that the take up coil is disposed on a hollow coil tension mandrel made from a fiber reinforced, in particular carbon fiber reinforced laminated material with a high elasticity material which is fixedly mounted with the hollow drive shaft being made of steel, whereby the hollow drive shaft has a substantially larger outer diameter with respect to the outer diameter of the coil tension mandrel. The coil tension mandrel of the described laminated material results in an extremely high rigidity in the required low diameter. The coil tension mandrel can then be connected with the hollow drive shaft which is enlarged in its diameter, whose bending stiffness reduces oscillations or eliminates them completely.

For generating the required differential speed between the take up coil and the single lay rotor of the single lay device and the take up device, on the one hand, and the associated lay stroke with respect to the reciprocal movement of the single lay rotor, a further embodiment of the invention is of a particular advantage. It is characterized in that a stepless adjustable drive is switched successively to a drive motor which supplies the nominal lay speed for controlling the speed of the single lay rotor and thereby the differential speed, the output of this drive is rotatably connected with the drive shaft of the single lay rotor and for adjusting the stepless adjustable drive a corresponding actual signal is generated by the actual rope pull during the entering of the rope into the single lay rotor being compared with a nominal signal corresponding to the nominal rope pull, the comparison signal is fed to a control, whose output signal is fed to the set member (set motor) of the drive, and for controlling the speed of the displacement movement of the displacement carriage for the single lay rotor the nominal lay speed and the output speed of the stepless adjustable drive are fed to a sun wheel of a planet wheel drive of a coaxial bevel wheel drive with an outer gear of the two sun wheels and the output speed of the rib of the planet wheel drive is fed, if need be, to the input of a lay stroke drive for the displacement carriage by means of a suitable transmission.

Thereby, it is possible to combine the differential speed between the take up coil and the single lay rotor as well as the speed of the displacement movement of the displacement carriage, namely to control it at an optimum in dependence on the tensile stress of the rope being fed to the single lay rotor and thereby in dependence on the take up diameter on the take up coil for obtaining, in this manner, a sufficient laying of the rope on the take up coil without exceeding the permissible rope tensile stress. This is achieved with the assistance of simple and robust means by shunting off the speeds from a single drive motor.

As mentioned above, the braking of the stranding machine system and in particular the emergency braking in case of a wire break represents a particular problem. The braking can be obtained in an advantageous manner in accordance with the invention with the assistance of the strand lay machine system in accordance with the invention with the described preswitching of a prestranding machine in such a manner that for braking the system, in particular in case of a wire break in the rope elements, the nominal lay speed of the prestrand rotor and thereby the take up coil are maintained constant in a predetermined total braking time during a first predetermined braking time section. However the drive speed of the drawing off disk and thereby the lay length and feeding speed of the rope are reduced to a predetermined lowermost possible degree, and during this and/or after this first braking time segment the complete braking of the remaining machine parts (drawing off disk, prestrand rotor, take up coil and single lay rotor) is initiated and performed within the remaining second braking time segment. Thus, this emergency braking must not be performed under an immediate and lasting short time braking of all involved machine parts with their high mass inertia moments. Rather, the feeding speed of the rope is reduced as much as possible by reducing the lay length at first, so that at a constant speed of the take up coil a lower rope path with a corresponding reduced take up speed must be taken up and thereafter the actual braking process is performed by braking the remaining machine parts. In this manner the total rope length can be reduced to a minimum during this braking process. Thereby, it is particularly advantageous that during the braking process the control of the take up process is not performed over the take up coil with its especially high mass inertia moment, but that the remaining machine parts and in particular the single lay rotor with its substantially lower, and above all, constant mass inertia moment must be influenced in a controlled manner. A further favorable possibility of braking with these advantages consists in a braking process after a predetermined delay curve through a process computer with an advance of the braking time, i.e., a control with constant delay value.

In the aforementioned as well as in the following description of the expression "nominal lay speed" refers always to the speed corresponding to the nominal lay speed of the rope to be made.

Features, further advantages and details of the invention are stated in the following description of exemplified embodiments of the invention in conjunction with the drawing. For simplification purposes the drawings are substantially schematic and contain only those parts of the stranding machine system which are required for explaining the invention.

DESCRIPTION OF A PREFERRED EMBODIMENT

Figure 1:
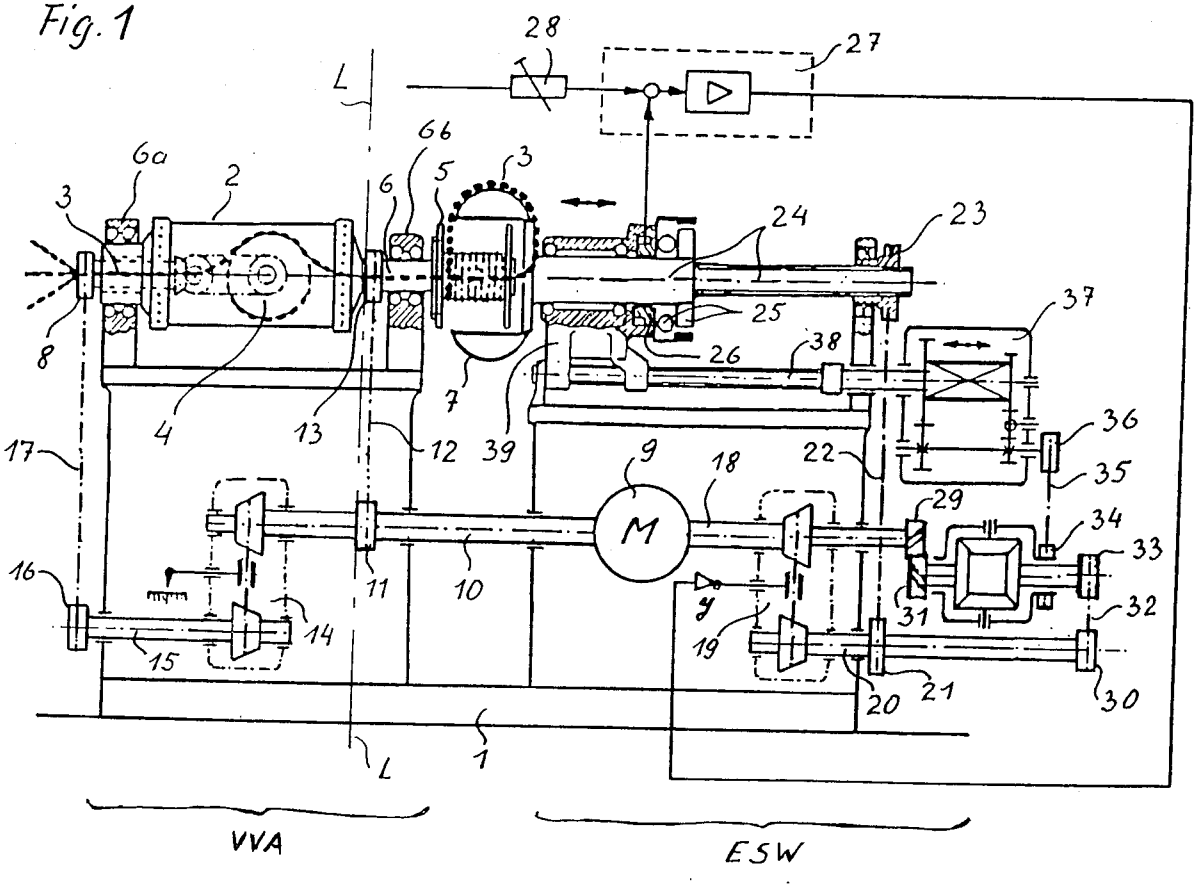
FIG. 1 a partially sectioned side view of one embodiment of the stranding machine system in accordance with the invention with the single lay and take up device and a prestranding machine which is switched in front thereof with a driven drawing off disk, FIG. 2 a partially sectioned partial view in plan view of the open part of the single lay rotor of the single lay and take up device, FIG. 3 a schematic perspective view of a single lay rotor of the single lay and take up device with a rope guide, FIG. 4 a schematic view of the open end of the single lay rotor in accordance with FIG. 2 and FIG. 3 as a demonstration of the geometrical relationsip, FIG. 5 a sectioned partial view of the take up coil with its hollow drive shaft and the associated single lay and take up device in a particular embodiment.

A stranding machine system in accordance with the invention is explained in its principle in conjunction with a particular embodiment in accordance with FIG. 1. A prestranding machine, generally designed with VVA, is arranged in front of a single lay and take up device, generally designated with ESW, in a stranding machine system. As will be explained in detail, a prestranding rotor and a hollow take up coil are rigidly coupled with each other to form a unitary piece. However, it is already stated at this point that the single lay and take up device up to the hollow drive shaft of the take up coil can be considered as a complete stranding machine system in form of a single lay machine with a take up system, to which in a further embodiment a prestranding machine can be separately pre-arranged by combining the drives, similarly to the principle illustrated in FIG. 1.

The prestranding machine which in FIG. 1 is designated as VVA is advantageously made in such a manner as described in DE-PS No. 32 09 169, and, if need be, supplemented in accordance with DE-OS No. 32 26 572. The total stranding machine system in accordance with FIG. 1 is mounted on a common machine frame 1. The rope which is made and guided in the stranding machine system is generally designated with 3. The prestranding machine is provided with a prestranding rotor 2. A driven drawing off disk 4 is mounted in the prestranding rotor and wound around by a rope 3, as illustrated and described in detail in DE-PS No. 32 09 169. For simplification of the illustration a single drawing off disk is schematically illustrated. The prestranding rotor 2 is provided with a hollow drive shaft 6 and is rotatably mounted at both sides at *6a* and *6b*. In the embodiment illustrated in FIG. 1, the hollow drive shaft 6 of the prestranding rotor 2 extends beyond the shaft mounting *6b* in the rope feeding direction. A take up coil 5 lies freely on this extension of the hollow drive shaft 6, as will be described in detail. The take up coil 5 is connected in one piece with the prestranding rotor 2 by means of the hollow drive shaft 6 and is therefore always driven with the same speed, namely a nominal lay speed.

The rope 3 is fed through the hollow prestranding machine VVA and to the single lay and take up device which will be described in detail is generally designated as ESW. The take up coil 5 has to be considered as a component of the single lay and take up device, as will be explained.

As already explained, the take up coil 5 is driven together with the prestranding rotor 2 with the same speed, namely the nominal lay speed. The rotating drive for the prestranding rotor 2 and thereby the take up coil 5 which rotates always in uniformly fast and equidirectional fashion, as well as the rotating drive for the drawing off disk 4 within the prestranding rotor 2 in accordance with DE-PS No. 32 09 169 for the associated schematically illustrated planetary drive with its drive disk 8 of the prestranding machine VVA, as well as the rotating drive for the single lay rotor 7 of the single lay and take up device ESW are positively driven from a common drive motor 9 by a mechanical forced drive. The drive motor 9 drives a drive disk 11 by a shaft 10 which, for example, drives a drive disk 13 for the hollow drive shaft 6 and thereby for the prestranding rotor 2 as well as for the take up coil 5 by means of a drive belt 12. Furthermore, by means of an adjustable drive 14, the drive system for the drawing off disk in the prestranding rotor 2 is coupled with the shaft 10 of the drive motor 9 by a drive shaft 15 and a drive disk 16 with a drive belt 17, as well as the drive disk 8. Through a further output shaft 18 of the drive motor 9, a stepless drive 19 is driven. This drive 19 is remotely adjustable by means of a suitable set member, for example, an electric set motor y. A drive shaft generally designated with the numeral reference 24 for the rotating drive of the single lay rotor 7 is coupled by means of its output shaft 20 and a belt pulley 21 as well as a belt 22 and a drive disk 23. A drive shaft 24 which is a two part shaft, permits an axial movement of the two parts against each other during transmission of the rotation, for example, with assistance of a bushing with an endless ball rotation or a so-called rotating movement ball bushing with a profile shaft rigidly connected with the drive disk 23.

At the start of the stranding, the transmission relationship is determined on the adjustable drive 14, and thereby the speed relationship between the speed for the drawing off disk 4 and the speed of the prestranding rotor 2 and therefore the rope lay length to be generated by the prestranding machine VVA is defined.

As already explained, the single lay rotor 7 of the single lay and take up device ESW must advance or advantageously lag behind the take up coil 5 with a corresponding differential speed in dependence on the rope feeding speed and on the speed of the prestranding rotor 2 and thereby simultaneously the take up coil 5, and in dependence on the given take up diameter obtained by the take up coil 5. The transmission relationship on the stepless adjustment drive 19 must be constantly automatically adjusted until reaching the full winding of the take up coil 5, beginning with a differential speed with an empty take up coil 5.

As already described before, the rope 3 is fed through the hollow drive shaft 6 of the prestranding rotor 2 and take up coil 5 from the longitudinal axis of the single lay rotor 7 and along of the same to the take up coil 5, as illustrated schematically in FIG. 1.

In accordance with the invention, the described controlled change of the transmission relationship on the adjustment drive 19 for changing the differential speed between the single lay rotor 7 and the take up coil 5 depending on the winding condition, is performed in the exemplified embodiment of FIG. 1 in the following manner: In order for the rope not to slip on the drawing off disk 4 it must be tensioned with a minimum tension load after leaving the drawing off disk 4 in accordance with the known Eulerschen rope winding formula. The single lay rotor 7 with its shaft 24 is axially loaded on the deflection location of the rope when entering into the single lay rotor 7, depending from the tension load. Over an axial shaft mounting 25, with the outer part of the drive shaft 24 supported in a carriage 39 which still has to be described, the single lay rotor 7 presses more or less a pressure measuring device which is arranged at this location and formed, for example, as a so-called force absorber 26. The actual rope tension measured as a pressure measuring value is compared in a control 27 with a nominal rope tension which is predetermined by a potentiometer 28 adjusted before the start of the stranding process. If the differential speed of the single lay rotor 7 is too high with respect to that of the take up coil 5, the actual rope tension increases in the area of the single lay rotor 7. The pressure on the pressure measuring device 26 also increases in this case. The control 27 then acts in a superimposed manner on set member y. The transmission relationship is corrected by means of drive 19 until the differential speed between the single lay rotor 7 and the take up coil 5 is reduced to corresponding values. During a nonpermissible reduction of the actual rope tension in the rope 3 the differential speed is reversely increased by the described device until the equilibrium is again restored.

Thus the speed of the single lay rotor 7 and thereby the differential speed between the single lay rotor 7 and take up coil 5 is controlled in dependence on the tensile stress of the rope 3 which is fed to the single lay rotor 7 and corresponding to the winding diameter on take up coil 5.

For winding up of the rope the already illustrated axial reciprocating movement of the single lay rotor 7 is to be performed. This so-called lay stroke movement of the single lay rotor 7 is performed in accordance with the invention in the following manner:

The true take up speed, i.e., the differential speed, the rope feeding speed, as well as the lay step width which has to be adjusted before the start of the production depending on rope thickness or rope diameter, are decisive for the lay stroke speed. In the exemplified embodiment of FIG. 1 the required control and regulation of the lay stroke in dependence on the described differential speed are explained. The nominal lay speed with which the take up coil 5 rotates is picked up by a rotating output gear 29 and by the shaft 20 through a belt disk 21 associated with the input speed of the drive shaft 18 of drive 19, on the one hand, and the speed of the single layer rotor 7, on the other hand. The rotating direction of the gear 29 is reversed with a counter gear 31 which is in camming engagement therewith. The rotation of a belt disk 30 is transmitted through a drive belt 32 to a belt disk 33. The drive wheels or disks 31 and 33 are connected through associated shafts with one each sun wheel of a planet wheel drive designed as a coaxial bevel wheel rotating drive with an outer gear of the two sun wheels in the schematically illustrated manner. The sun wheels are rotatably connected with an encompassing planet wheel rib. The rib in return is fixedly connected with an output wheel 34. Thus, the speed of the rib of the planet wheel drive is transmitted through a drive belt 35 to an associated drive disk 36. The drive disk 36 drives an axially displaceable displacement carriage 39 by means of a schematically shown reverse drive 37 which is designed in a suitable manner and a lay stroke spindle 38, which in accordance with FIG. 1 supports the mounting box for the single lay rotor 7 with its associated rotating drive shaft 24 of the single lay and take up device ESW.

In order to also adjust the lay stroke and the lay stroke speed in a stepless manner, it may be advantageous to use a known roller cage drive for traversing movements, instead of the illustrated reverse drive.

As already stated before, the embodiment in accordance with FIG. 1 represents a stranding machine system in an embodiment wherein a prestranding machine with a single lay and take up device are coupled in accordance with the invention. Further embodiments in deviation from FIG. 1 are possible. First of all, it is possible to separately drive and mount the single lay rotor 2 with its drawing off disk 4, on the one hand, and the take up coil 5 with the associated hollow drive shaft, on the other hand, in contrast to FIG. 1, that is, to "separate" the drive shaft 6 and to mount both machine segments accordingly. Thereby, the hollow drive shaft of the take up coil 5 is advantageously mounted twice on a larger length and an enlarged diameter for avoiding oscillations.

A further embodiment consists in that a prestranding machine in accordance with FIG. 1 is not used at all and that the single lay and take up device in accordance with the invention are designed independently from each other as a single lay machine with a take up device. Thereby, the take up coil 5 with its hollow drive shaft 6 is also mounted on an independent machine frame within the total frame 1, again advantageously on a longer hollow drive shaft and a double mounting in a larger distance with an enlarged shaft diameter.

The stranding machine system illustrated in FIG. 1 ends on the dash-dotted separating line L. Such a system represents a complete single lay machine with a take up device which can be operated on its own or with other pre-arranged systems.

Figure 2:
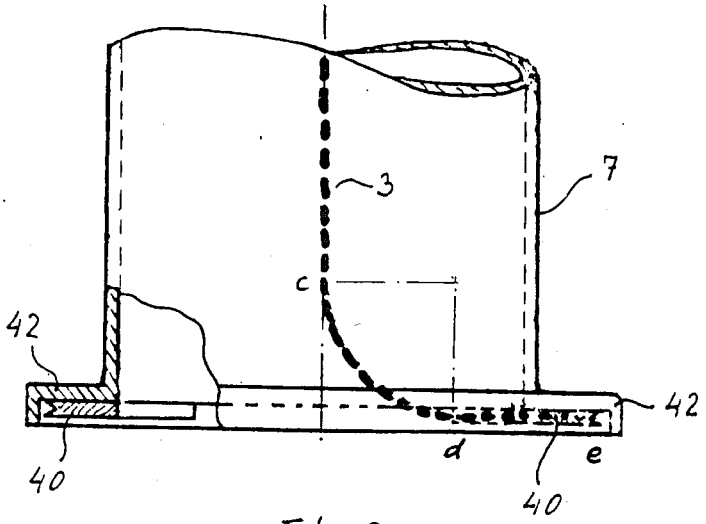
Figure 3:
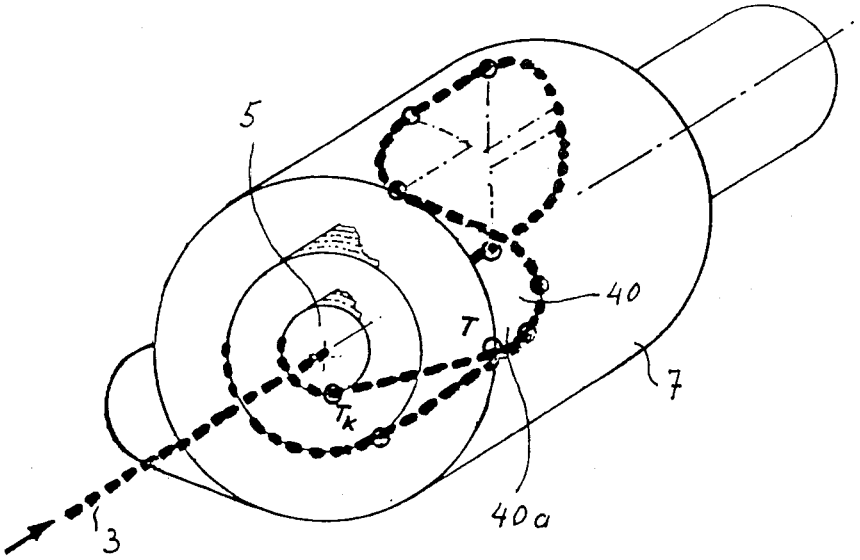
Figure 4:
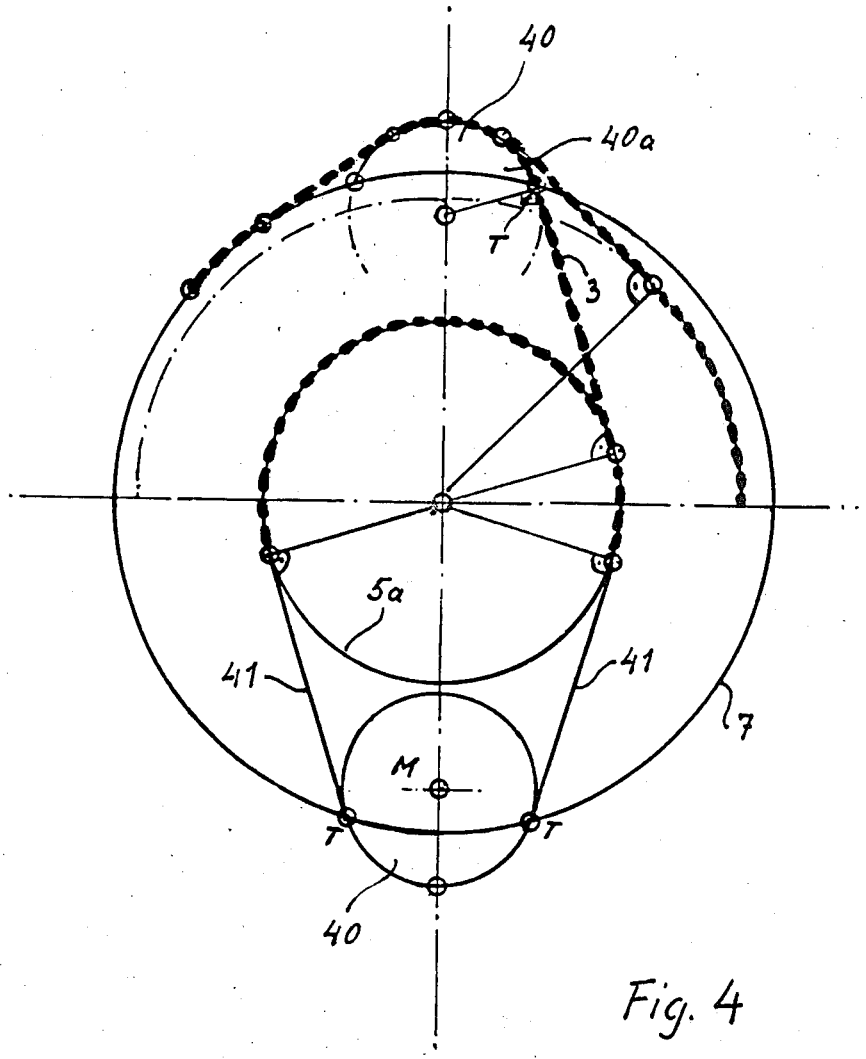

FIGS. 2 to 4 illustrate a particularly advantageous embodiment of the single lay rotor 7 in a schematic manner for reasons of rigidity and in particular for reasons of an optimum feeding of the rope.

As shown in FIG. 1 and particularly in FIG. 3, the single lay rotor 7 of the single lay and take up device ESW is formed as a one sided closed hollow element encompassing the take up roller. The rope 3 is fed through the hollow drive shaft 6 of the take up coil 5 and to the end facing away from the single lay rotor, and from there from the longitudinal axis of the single lay rotor 7 and along of the same to the take up coil 15. Thereby, it is required to guide the rope from its longitudinal guide into a circumferential or tangential movement, so as to feed it to the take up coil 5. The feeding on the body of the single lay rotor 7 is performed in a suitable manner, for example, through ceramic tubes, sliding paths, hollow pins, or the like. The basic rope feeding is illustrated in particular in FIG. 3.

In accordance with the invention, the single lay rotor has at least one radial outwardly directed protrusion 40 provided on the outer circumference of its open end and forming a guide path which in its cross sectional plane is curved for the rope 3 to be fed to the take up coil 5, as illustrated in FIGS. 2 and 4. Thereby, the rope 3, after its feeding along the inner face of the jacket of the single lay rotor 7, is fed to the beginning of this guide path 40 and moves from the end of the guide path 40 to the take up coil 5.

For a sufficient rope feeding it is highly advantageous not to go below a lowermost possible curvature radius at any location. This becomes critical at the location at which the rope leaves the guide path at the protrusion 40 for moving tangentially to the take up roller 5. With this type of feeding, different rope movements have to be taken into consideration at the end of guiding path 40 with an empty coil core, on the one hand, and with a filled coil, on the other hand. FIG. 4 schematically illustrates geometrical relationships and demonstrates a further embodiment in conjunction therewith: In order to avoid any impermissible tight tope curvature and in particular to avoid a rope break when leaving the guide path 40, the center point M of a curvature circular segment of the end segment 40*a* of the guide path 40 is disposed in such a manner in accordance with the invention that a commom tangent 41 of a coil core circle 5*a* and a curvature circular segment 40*a* meet at the point T of the circumference of the single lay rotor 7 at which point the rope leaves the single lay rotor 7 at the start of the take up process. These geometric relationships are schematically illustrated in FIG. 4, and both extreme positions of the rope feeding on the take up roller 5 are also schematically illustrated in FIG. 3. FIG. 3 also illustrates a second protrusion mounted diametrically to the protrusion 40 and compensating the imbalance generated by this protrusion. It is not required for the operation of the device.

As FIG. 2 illustrates, the open end of the single lay rotor 7 is provided with a collar 42 on the outer circumference, which covers the guide path in a radial distance, thus permitting movement of the rope.

Figure 5:
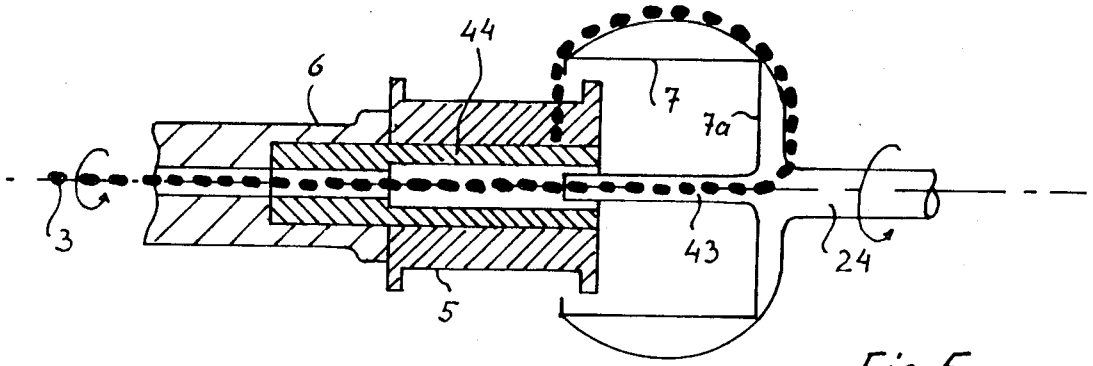

FIG. 5 illustrates in a sectioned partial view a particular embodiment of the single lay and take up device for avoiding disadvantageous rope oscillations during the movement of the rope between the take up roller 5 and the single lay rotor 7, thus providing an accurate rope feeding. As FIG. 5 illustrates, the single lay rotor 7 is provived on its closed bottom face 7*a* with a rope guiding tube 43 extending coaxially to the hollow drive shaft 6 and directed towards the take up coil 5. The rope guiding tube 43 has a smaller outer diameter than the inner diameter of the hollow drive shaft 6, and the rope 3 is fed through the tube 43 from the hollow drive shaft 6 to the single lay rotor 7. Furthermore, as illustrated in FIG. 5, the take up coil 5 is mounted on a hollow coil tension mandrel 44 made of a fiber reinforced, in particular carbon fiber reinforced laminated material with a high modulus of elasticity. The coil tension mandrel 44 is fixedly connected with the hollow drive shaft 6 which is made from steel, and the hollow drive shaft 6 has a substantially greater outer diameter with respect to the outer diameter of the coil tension mandrel 44, so as to achieve a high stability against oscillations.

It will be understood that each of the elements described above, or two or more together, may also find a useful application in other types of constructions differing from the types described above.

While the invention has been illustrated and described as embodied in a stranding machine system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A stranding machine system, comprising a single lay and take up coil device for a rope, said device including a take up coil and a coaxial single lay rotor having a longitudinal axis and being rotatable and encompassing said take up coil, said take up coil and said single lay rotor being movable axially in a reciprocating movement relative to each other for generating a lay stroke so that the rope is fed from said longitudinal axis of said single lay rotor along the same to said take up coil, said take up coil being rotatably driven with a nominal lay speed and said single lay rotor being separately rotatably driven with a speed required to generate a differential speed in dependence upon an obtained take up diameter, said single lay rotor being formed as a hollow element which is closed at its one side, said take up coil being mounted freely lying in an axial direction, said single lay rotor encompassing said take up coil and being mounted freely lying on said closed one side, said single lay rotor being driven reciprocably in the axial direction; and means for separately rotatably driving said take up coil with said nominal layer speed and said single lay rotor to generate the differential speed, said driving means including a hollow coil drive shaft having an end supporting said take up coil so that said take up coil is mounted on said end, said driving means also including a rotor drive shaft which is reciprocably displaceable and carries said single lay rotor so that said single lay rotor is rotatably mounted on said rotor drive shaft.

2. A stranding machine system as defined in claim 1, wherein said drive means further including a reciprocably displaceable carriage which rotatably supports said rotor drive shaft; and further comprising a stationary machine part arranged so that said displacing carriage is driven reciprocably on said stationary machine part.

3. A stranding machine system as defined in claim 2, wherein said drive means includes a drive motor for controlling the speed of said single lay rotor and thereby the differential speed, and a stepless drive successively switched to said drive motor and having an output rotatably connected with said rotor drive shaft and generating an actual signal corresponding to an actual tensile stress during entry of the rope into said single lay rotor for adjusting said stepless drive being compared with a nominal signal corresponding to a nominal tensile stress so as to form a comparison signal; and further comprising control means receiving the comparison signal and producing an output signal; a set member for said stepless drive and receiving said output signal of said control means; and means for regulating the speed of a displacement of said displacement carriage of said single lay rotor.

4. A stranding machine system as defined in claim 3, wherein said displacement carriage has a layer stroke device having an input, said regulating means including a planet wheel drive which is formed as a coaxial bevel wheel rotating drive with two sun wheels, so that for regulating the speed of the displacement movement of said displacement carriage a nominal lay speed is fed and an output speed of said stepless adjustable drive is fed, after a rotation reversal of one of the rotations, to a respective one of said sun wheels of said planet wheel drive, and an output signal of said planet wheel drive is fed to said input of said lay stroke device for said displacement carriage.

5. A stranding machine system as defined in claim 4; and further comprising a transmission through which said output signal of said planet wheel drive is fed to said input of said lay stroke device for said displacement carriage.

6. A stranding machine system as defined in claim 1; and further comprising a stationary machine part, said hollow coil drive shaft having an end which is mounted in said stationary machine part.

7. A stranding machine system as defined in claim 1; and further comprising a prestranding machine provided with a prestranding hollow shaft, a prestranding rotor mounted on said prestranding shaft, and a driven drawing off disk provided on said prestranding rotor and arranged upstream of said coil drive shaft of said take up coil, so that the rope discharges from said prestranding shaft of said prestranding rotor and is fed to said coil drive shaft of said take up coil.

8. A stranding machine system as defined in claim 7, wherein said prestranding shaft of said prestranding rotor and said coil drive shaft of said take up coil together form a unitary element.

9. A stranding machine system as defined in claim 7; and further comprising means for braking, in particular in the case of a wire break in the rope.

10. A stranding machine system as defined in claim 1, wherein said single lay rotor has an open end with an outer periphery and is provided on said outer periphery of said open end with at least one radially outwardly extending projection, said projection having an outwardly directed edge which forms in its cross sectional plane a curved guide path for the rope to be fed to said take up coil, so that the rope after being fed on an inner side of said single lay rotor is fed to a start of said guide path and moves from an end of said guide path to said take up coil.

11. A stranding machine system as defined in claim 10, wherein said open end of said single lay rotor is provided with a collar on the outer periphery arranged so that said collar covers said guide path with a radial distance permitting the rope to move therethrough.

12. A stranding machine system as defined in claim 1, wherein said single lay rotor has a closed bottom face and is provided on said closed bottom face with a rope guiding path which extends coaxially with said coil drive shaft toward said take up coil and has a smaller diameter than that of said coil drive shaft so that the rope is fed through said rope guide path from said coil drive shaft to said single lay rotor.

13. A stranding machine system as defined in claim 1; and further comprising a hollow coil tension mandrel arranged to support said take up coil, said mandrel being composed of a fiber reinforced laminated material with a high elasticity coefficient, said coil drive shaft being compsoed of steel and fixedly connected with said mandrel, said coil drive shaft having an outer diameter which is substantially larger than that of said tension mandrel.

14. A stranding machine system as defined in claim 13, wherein said coil tension mandrel is composed of a carbon fiber reinforced laminated material.

* * * * *